US007841589B2

(12) United States Patent
Kawata

(10) Patent No.: US 7,841,589 B2
(45) Date of Patent: Nov. 30, 2010

(54) IMAGE FORMING APPARATUS

(75) Inventor: Wataru Kawata, Kashiwa (JP)

(73) Assignee: Canon Kabushiki Kaisha (JP)

( * ) Notice: Subject to any disclaimer, the term of this patent is extended or adjusted under 35 U.S.C. 154(b) by 109 days.

(21) Appl. No.: 11/610,629

(22) Filed: Dec. 14, 2006

(65) Prior Publication Data

US 2007/0132176 A1 Jun. 14, 2007

(30) Foreign Application Priority Data

Dec. 14, 2005 (JP) ..... 2005-360297

(51) Int. Cl.
*B65G 33/04* (2006.01)
*B65G 39/00* (2006.01)
*G03G 15/00* (2006.01)

(52) U.S. Cl. ..... 270/58.12; 270/58.16; 270/58.17; 270/58.27; 270/58.11; 270/58.08; 270/58.09; 270/58.07; 399/407; 399/408; 399/409; 399/410

(58) Field of Classification Search ..... 270/58.12, 270/58.16, 58.17, 58.27, 58.11, 58.08, 58.09, 270/58.07; 399/407–410
See application file for complete search history.

(56) References Cited

U.S. PATENT DOCUMENTS

| | | | | |
|---|---|---|---|---|
| 6,241,234 | B1 * | 6/2001 | Saitoh et al. | 270/58.12 |
| 6,324,377 | B2 * | 11/2001 | Ando et al. | 399/395 |
| 6,988,725 | B2 * | 1/2006 | Rapkin | 271/227 |
| 2003/0219294 | A1 * | 11/2003 | Yoshimura et al. | 399/408 |
| 2003/0230845 | A1 * | 12/2003 | Fujii et al. | 271/176 |

FOREIGN PATENT DOCUMENTS

| | | | |
|---|---|---|---|
| EP | 1096780 | A2 * | 5/2001 |
| JP | 10-181981 | A | 7/1998 |
| JP | 2001-125440 | A | 5/2001 |

* cited by examiner

*Primary Examiner*—Gene Crawford
*Assistant Examiner*—Yolanda Cumbess
(74) *Attorney, Agent, or Firm*—Rossi, Kimms & McDowell LLP

(57) ABSTRACT

After an image was formed, a position in the width direction of the sheet stacked on a stacking portion is aligned by fixing one of aligning plates which can independently be driven and moving the other aligning plate in one direction. When the image is formed onto the sheet, a side edge of the sheet on the side which is come into contact with the aligning plate on the side fixed as a reference wall upon aligning is used as a reference and the image is formed.

15 Claims, 13 Drawing Sheets

IMAGE FORMING APPARATUS

BACKGROUND OF THE INVENTION

1. Field of the Invention

The present invention relates to an image forming apparatus and, more particularly, to position control of an image which is formed on a sheet. More particularly, the invention relates to an image forming apparatus which can align image forming positions at high precision when a sheet is processed.

2. Description of the Related Art

Hitherto, in an image forming apparatus such as a copying apparatus, a laser beam printer, a facsimile, hybrid apparatus (a multi function apparatus) of them, or the like, a surface of a photosensitive drum is exposed by an exposing device, a latent image is formed onto the photosensitive drum, and thereafter, the latent image is developed, thereby forming a toner image. Further, the toner image is transferred onto a sheet and, thereafter, the transferred toner image is fixed onto the sheet by a fixing device.

In such a conventional image forming apparatus, there is an apparatus in which when the toner image is transferred, an image forming (transferring) position is corrected in accordance with a position in the sheet width direction which perpendicularly crosses the sheet conveying direction for the photosensitive drum so as to transfer the toner image to a predetermined position of the sheet.

FIG. 13 shows a construction of an image forming portion of such a conventional image forming apparatus which can correct the image forming position. When sheets Sa and Sb are conveyed for a photosensitive drum 300 so as to have edge positions X and X', respectively, the start positions on which images are started writing onto the photosensitive drum 300 by writing units 3 and 4 are controlled so as to change them in correspondence to the edge positions X and X' of the sheets Sa and Sb. Such control is made by automatic writing position deciding means.

According to Japanese Patent Application Laid-Open No. 2001-125440, in the image forming apparatus having such automatic writing position deciding means, a deviation of a sheet S is detected by a plurality of detection elements and a position of image data in a memory is corrected on the basis of a detection result. According to the image forming apparatus disclosed in Japanese Patent Application Laid-Open No. 2001-125440, the deviation is detected at a detection resolution of 0.25 mm or higher and is corrected, thereby enabling the high-precision deviation correction to be realized by making the most of a writing position control ability which the digital writing units 3 and 4 having laser light emitting elements have.

In the conventional image forming apparatus, there is also an apparatus in which after the image forming position to the sheet was corrected at the high precision by the automatic writing position deciding means, in order to execute a process such as binding process, punching process, or the like to a sheet bundle in which a predetermined number of sheets have been stacked, a sheet processing apparatus is provided.

In such a sheet processing apparatus, each time the sheets on which images have been formed are ejected onto a processing tray one by one, a position of the sheet in the ejecting direction is aligned and a position of the sheet in the width direction is aligned by using an aligning plate. Further, as such a sheet processing apparatus, Japanese Patent Application Laid-Open No. H10-181981 discloses an apparatus in which a pair of aligning plates which can independently be driven are provided and when the position of the sheet in the width direction is aligned, the sheet is aligned while changing the aligning position by using the pair of aligning plates in accordance with a processing mode such as a stapling process or the like.

In the conventional image forming apparatus in which the image forming position is corrected in accordance with the position of the sheet in the width direction before the image is formed, the image forming position to the sheet can be controlled at the high precision. However, the sheet obtained after the image creation is expanded and contracted by heating and pressurization when the sheet passes through the fixing device. Further, an expansion/contraction amount differs depending on a toner amount of the image transferred to the sheet.

In the case where the sheets have been expanded or contracted as mentioned above, when the positions of the sheets in the width direction are aligned, since the sheets become irregular in the width direction, the edge portion of an image area formed on each sheet is also deviated.

Further, in the case where a bundle of sheets to be processed is constructed by sheets of different materials such as partition paper, cover, back cover, and the like, there is such a problem that a sheet irregular amount increases and the image forming area edge portion is also further deviated.

When the sheets as mentioned above are aligned and staple-processed as a sheet bundle, since they are bound in the sheet irregular state, there is such a problem that even if the image forming area edge portions from the edge portions of the sheets are aligned at high precision, an advantage as a product is not effected.

SUMMARY OF THE INVENTION

Therefore, a purpose of the invention to provide an image forming apparatus which can align image forming area edge portions at high precision when sheets are processed.

Another purpose of the invention is to provide an image forming apparatus having a sheet processing apparatus which processes after aligning sheets on which images are formed, including an image forming portion which forms an image onto a sheet, wherein the sheet processing apparatus has a stacking portion which stacks sheets on each of which an image is formed, and a pair of aligning members which are configured to face with each other and movable independently so that the pair of aligning members pinches side edges of the sheets in a direction perpendicular to a conveying direction in which the sheet is conveyed to the stacking portion to align the side edges of the sheets, wherein one of the aligning members is allowed to be chosen as a reference of the alignment, while the other of the aligning members aligns the side edges of the sheets by pressing the sheets against the one of aligning members, and wherein when an image forming portion which forms an image onto a sheet, the image forming portion forms an image at an image forming position which reference is on a basis of the sheet side edges to be abutted against the one of the aligning members. Thus, when the image is formed onto the sheet, by forming the image while the side edge position of the sheet on the side which is come into contact with the aligning member on the side fixed as an alignment reference is used as a reference, when the sheet is processed, the image forming area edge portions can be aligned at high precision.

A further purpose of the present invention will become apparent from the following description of exemplary embodiments with reference to the attached drawings.

DESCRIPTION OF THE EMBODIMENTS

Best mode for carrying out the invention will be described in detail hereinbelow with reference to the drawings.

Figure 1:
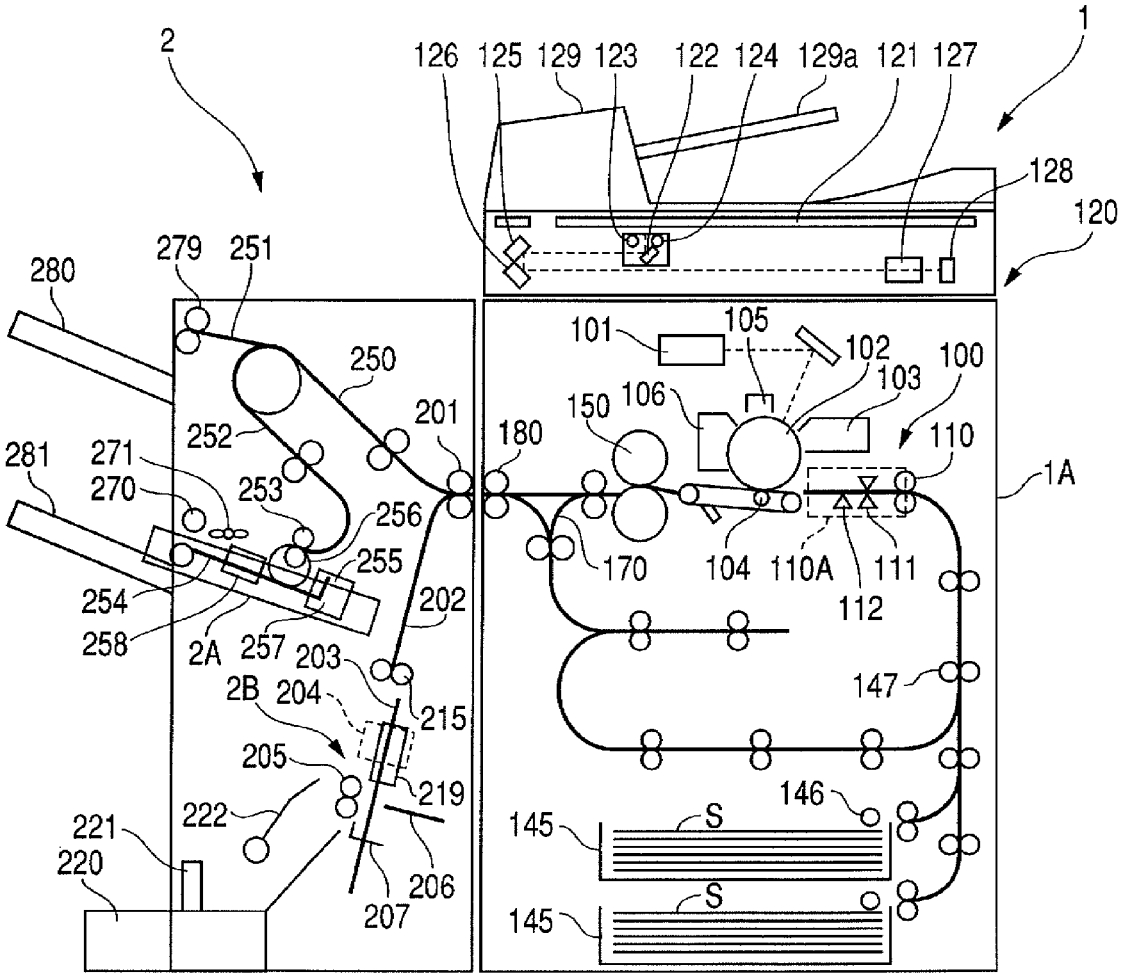
FIG. 1 is a diagram showing a construction of a copying apparatus as an example of an image forming apparatus having a sheet processing apparatus according to the first embodiment of the invention.

FIG. 1 is a diagram showing a construction of a copying apparatus as an example of an image forming apparatus having a sheet processing apparatus according to the first embodiment of the invention.

In FIG. 1, reference numeral 1 denotes a copying apparatus and 1A indicates a main body of the copying apparatus. An image reading device 120 having a platen glass 121 as an original setting base plate, a scanner unit 123, an automatic document feeder (ADF) 129 for feeding an original document to the platen glass 121, and the like is provided in an upper portion of the copying apparatus main body 1A.

An image forming portion 100 having a charging device 105, a cylindrical photosensitive drum 102, a developing unit 103, and the like is provided in the copying apparatus main body 1A. Further, a fixing device 150, a pair of ejecting rollers 180, and the like are provided on a downstream side of the image forming portion 100. The copying apparatus main body 1A has a sheet processing apparatus 2 for processing image-formed sheets which are ejected from the copying apparatus main body 1A.

The sheet processing apparatus 2 has: a binding part 2A for binding the image-formed sheets which are ejected from the copying apparatus main body 1A by a stapler 257; and a booklet processing part 2B for folding a bundle of sheets in half and booklet-binding the sheet bundle.

The copying apparatus 1 has: a control portion 10 (which will be explained hereinafter) shown in FIG. 6 for controlling the operations of the image reading device 120, image forming portion 100, sheet processing apparatus 2, and the like in accordance with predetermined programs; and an operation portion 11 having a display unit for confirming necessary information regarding the settings of various modes, operating state, and the like. The control portion 10 makes various kinds of control in accordance with the operating mode set by the operation portion 11.

The image forming operation of the copying apparatus main body 1A with such a construction and the sheet processing operation of the sheet processing apparatus 2 will now be described.

When a start button (not shown) is pressed, original sheets (not shown) stacked on an original tray 129*a* of the ADF 129 are sequentially conveyed onto the platen glass 121 one by one by the ADF 129. When the original is conveyed, a lamp of a scanner portion 122 is lit on and the scanner unit 123 having the scanner portion 122 is moved and irradiates the original.

Reflection light from the original passes through a lens 127 through mirrors 124 to 126 and, thereafter, enters a CCD image sensor portion (hereinafter, abbreviated to a CCD) 128. Inputted image information is photoelectrically converted into an electric signal by the CCD 128. After that, the converted electric signal is subjected to various image processes and the processed signal is inputted to the image forming portion 100.

Although the signal (image data) from the image reading device 120 is inputted to the image forming portion 100 in the embodiment, the invention is not limited to such a signal but image data which is transmitted from a personal computer or the like may be inputted to the image forming portion 100.

Subsequently, the signal inputted to the image forming portion 100 is converted into a photosignal by an exposure control portion 101 and irradiated onto the photosensitive drum 102 as an irradiation light according to the image signal, so that a latent image is formed on the photosensitive drum 102. The latent image formed on the photosensitive drum by the irradiation light in this manner is developed by the developing unit 103.

The sheets S enclosed in a feed cassette 145 are fed one by one by a feed roller 146 in parallel with the image forming operation. After that, the sheet is conveyed to an oblique motion correcting portion 110A and its oblique motion is corrected by the oblique motion correcting portion 110A. Further, timing is matched, the sheet is conveyed to a transferring portion 104, and a toner image formed on the photosensitive drum is transferred onto the sheet. A surface of the photosensitive drum after the toner image was transferred onto the sheet S is subjected to a process for removing residual extraneous matter such as transfer remaining toner or the like by a cleaning unit 106 and repetitively used for image creation.

Subsequently, the sheet S onto which the toner image has been transferred as mentioned above is conveyed to the fixing device 150 after that. The transfer image is permanently fixed by the fixing device 150. Thereafter, the image-fixed sheet S is ejected from the copying apparatus main body 1A by the ejecting roller pair 180 and conveyed to the sheet processing apparatus 2.

In the case of forming images onto both surfaces of the sheet, the sheet ejected from the fixing device 150 is reversed by a reversing path 170 and, thereafter, conveyed to the image forming portion 100 again and the image is formed onto the reverse surface of the sheet. After that, the image-formed sheet is conveyed to the sheet processing apparatus 2 by the ejecting roller pair 180.

When the sheet S is conveyed in this manner, in the sheet processing apparatus 2, for example, if the binding mode has been set, the sheet is conveyed to the binding portion 2A by an inlet roller 201 and the like, thereby binding the sheet bundle by the stapler 257. If a booklet processing mode has been set, the sheet is allowed to be fed to the booklet processing portion 2B.

Figure 2:
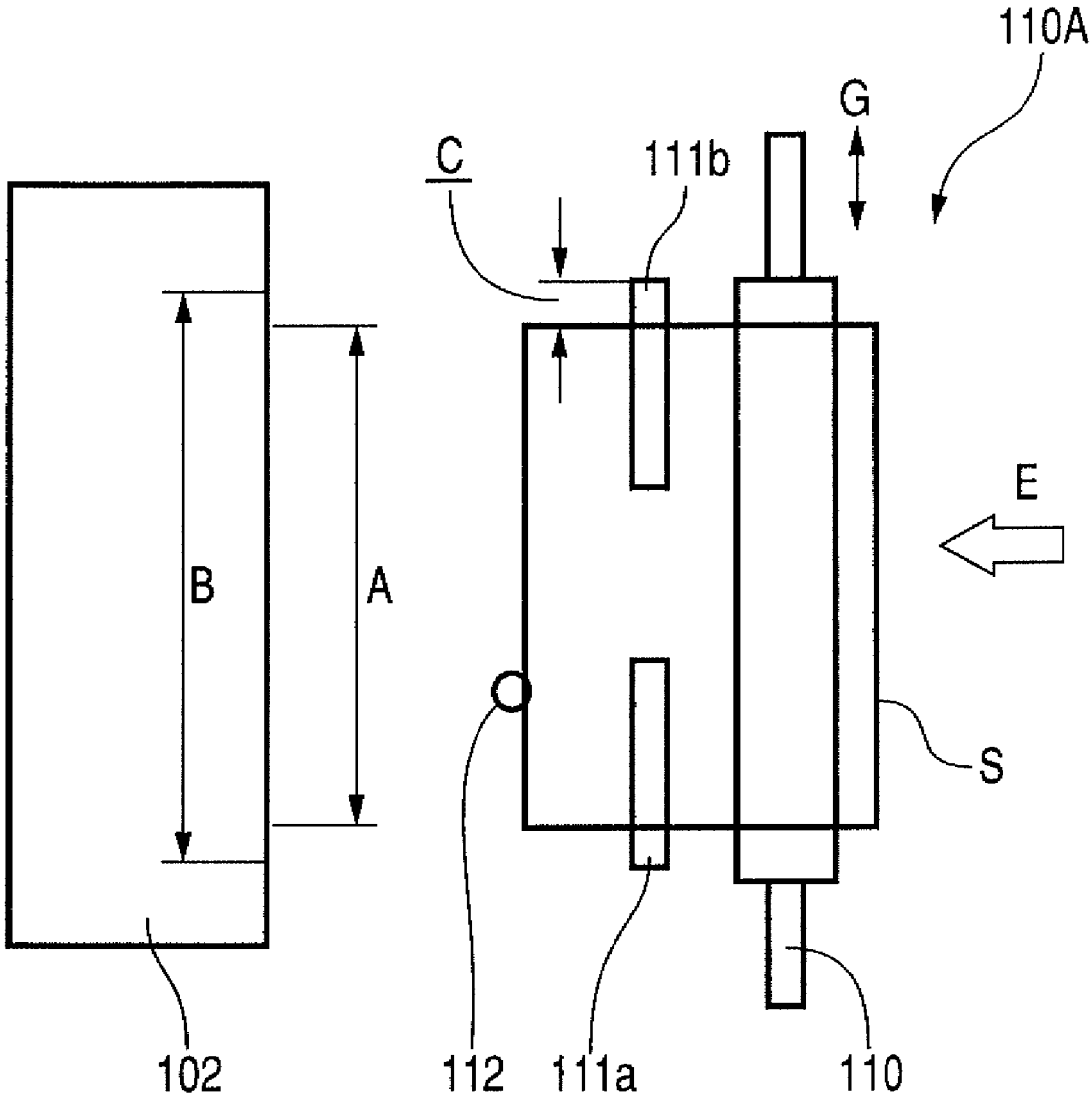
FIG. 2 is a diagram for explaining a construction of an oblique motion correcting portion provided for a main body of the copying apparatus.

The oblique motion correcting portion 110A has a registration roller 110 which is provided on an upstream side of the image forming portion 100. The registration roller 110 conveys the sheet S toward the image forming portion 100 and constructs a sheet moving unit which can be moved in the directions of arrows G which perpendicularly cross the sheet conveying direction as shown in FIG. 2. The oblique motion correcting portion 110A also has: a front edge detection sensor 112; and lateral position detection sensors 111*a* and 111*b* constructing a side edge detection portion for detecting both side edge positions of the sheet S in the width direction which perpendicularly crosses the sheet conveying direction shown by an arrow E.

Each of the lateral position detection sensors 111*a* and 111*b* is constructed by a contact type line sensor comprising a light emitting portion and a photosensitive portion. The sensors 111*a* and 111*b* are arranged so that they can detect at least both edges of the sheet S of the maximum size and both edges of the sheet S of the minimum size. In FIG. 2, reference character A denotes an image data area of the sheet S and B indicates an image writing area.

As for the sheet S conveyed from the registration roller 110, its passing position in the main-scanning direction which perpendicularly crosses the sheet conveying direction is detected by the lateral position detection sensors 111*a* and 111*b*. After that, the image data is shifted on the basis of detection information (recording material position data) from the lateral position detection sensors 111*a* and 111*b* and image area edge portions are shifted. Thus, the sheet S (image data area thereof) can be positioned into the image writing area.

In the embodiment, the lateral position detection sensor 111*a* of the front side and the lateral position detection sensor 111*b* of the rear side are selectively used in accordance with a setting mode of the sheet processing apparatus 2, which will be explained hereinafter. Detection information (recording material position data) collaterally includes how to use the lateral position detection sensors 111*a*, 111*b* as a reference position adjustment value.

Subsequently, when a front edge of the sheet S is detected by the front edge detection sensor 112 constructing a front edge detection portion, the sheet is fed to the transferring portion 104 after a predetermined time, and writing of the image shifted to a predetermined position of the sheet is started.

Figure 3:
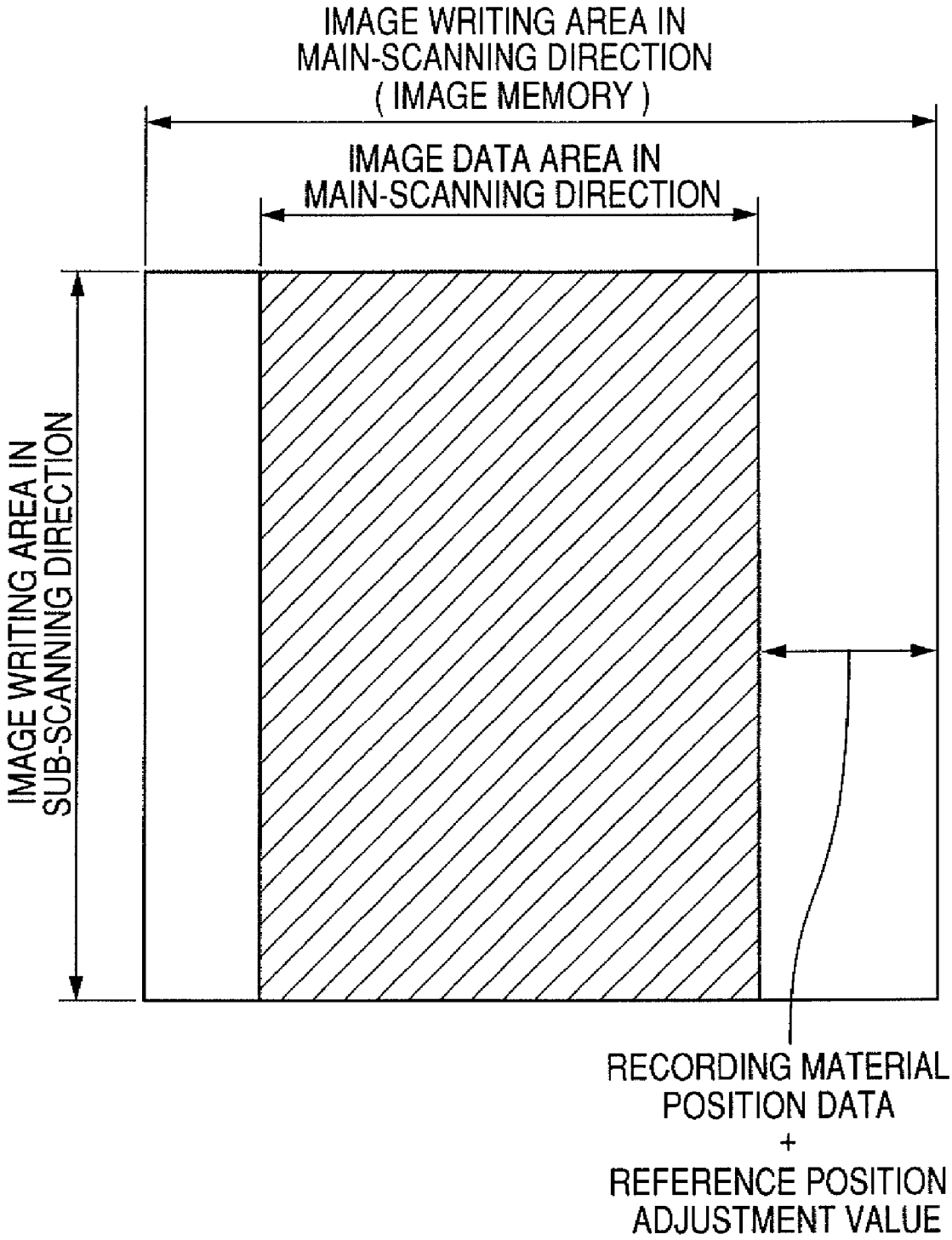
FIG. 3 is a diagram showing an image writing area, an image data area, and the like in an image forming portion provided for the copying apparatus main body.

The shift of the image data can be realized by a method whereby in an image memory arranged in image forming means 100A provided in the image forming portion 100 shown in FIG. 6, which will be explained hereinafter, the image data area in the main-scanning direction where the image data is actually written is shifted in the image writing area in the main-scanning direction as shown in FIG. 3. In this case, the shift of the image data can be realized by shifting a write address in accordance with a necessary shift amount on the basis of the addition of a reference position adjustment value to recording material position data. Since it is unnecessary to change reading timing of the image data and the like, processes can be rapidly executed.

For example, if a non-sort processing mode for simply stacking the sheets without executing a sorting process has been selected, the sheet is guided to a non-sort conveying path 251 shown in FIG. 1 and ejected onto a first stacking tray 280 by a first discharge portion 279.

Figure 4:
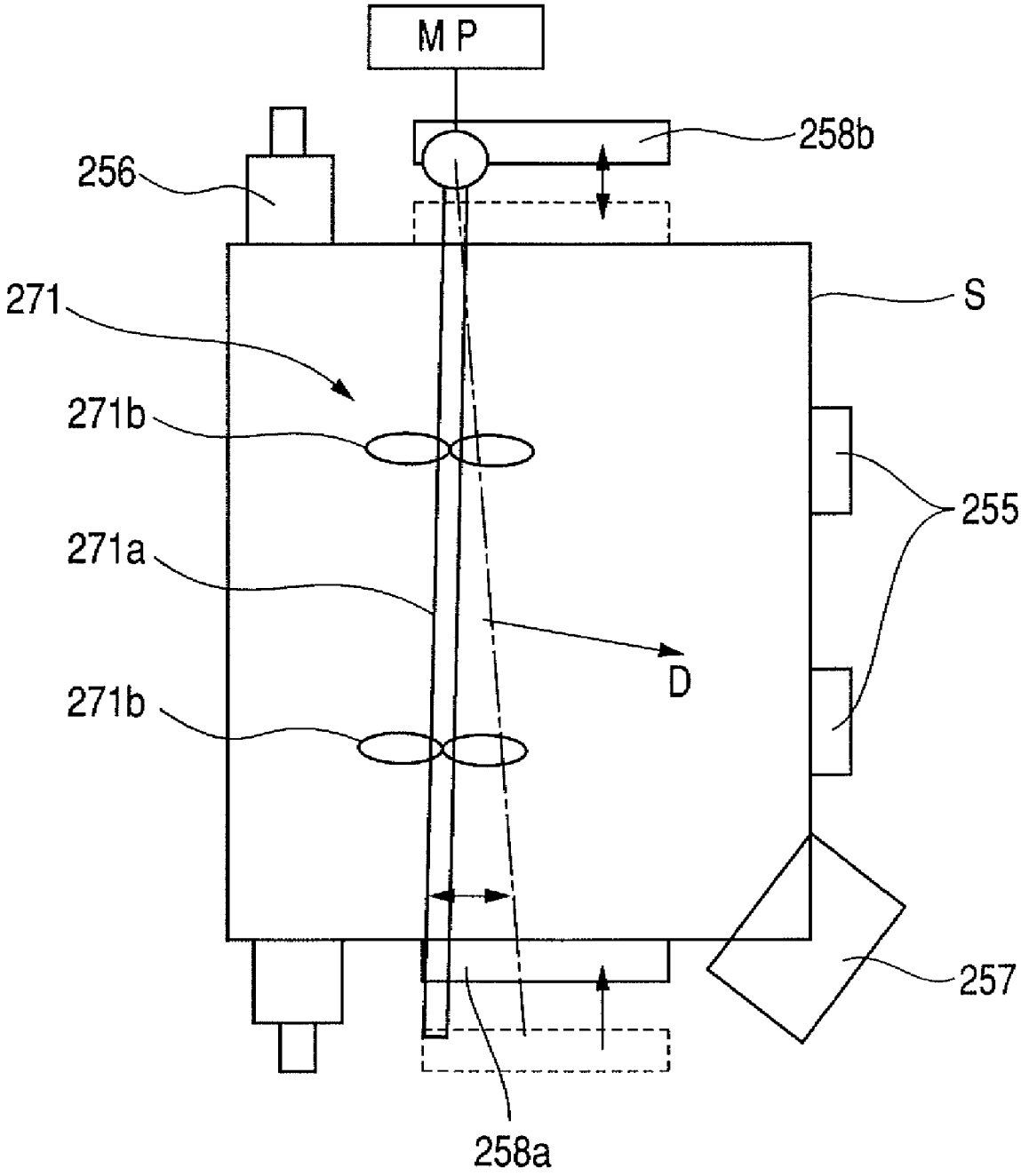
FIG. 4 is a diagram showing a state when a staple sort processing mode at one position of the front side in a binding portion of the sheet processing apparatus provided for the copying apparatus has been selected.

If a staple sort processing mode at one position of the front side has been selected by the operation portion 11, first, the stapler 257 is preliminarily moved to a position shown in FIG. 4. The staple sort processing mode at one position of the front side is a mode in which after the sheet bundle was bound at one position of the front side, each sheet bundle is shifted in the width direction and stacked, thereby sorting the sheet bundles.

A change-over flapper (not shown) is switched so that the sheet S ejected from the copying apparatus main body 1A is allowed to pass through a first sort conveying path 250 and can be guided to a second sort conveying path 252. A front side of the copying apparatus main body 1A denotes a position where the user faces the operation portion 11 so as to operate the apparatus. The side of the user who stands on the front side (obverse side of FIG. 1) of the copying apparatus main body 1A is referred to as a "front side" and the opposite side is referred to as a "rear side" hereinbelow.

Figure 5:
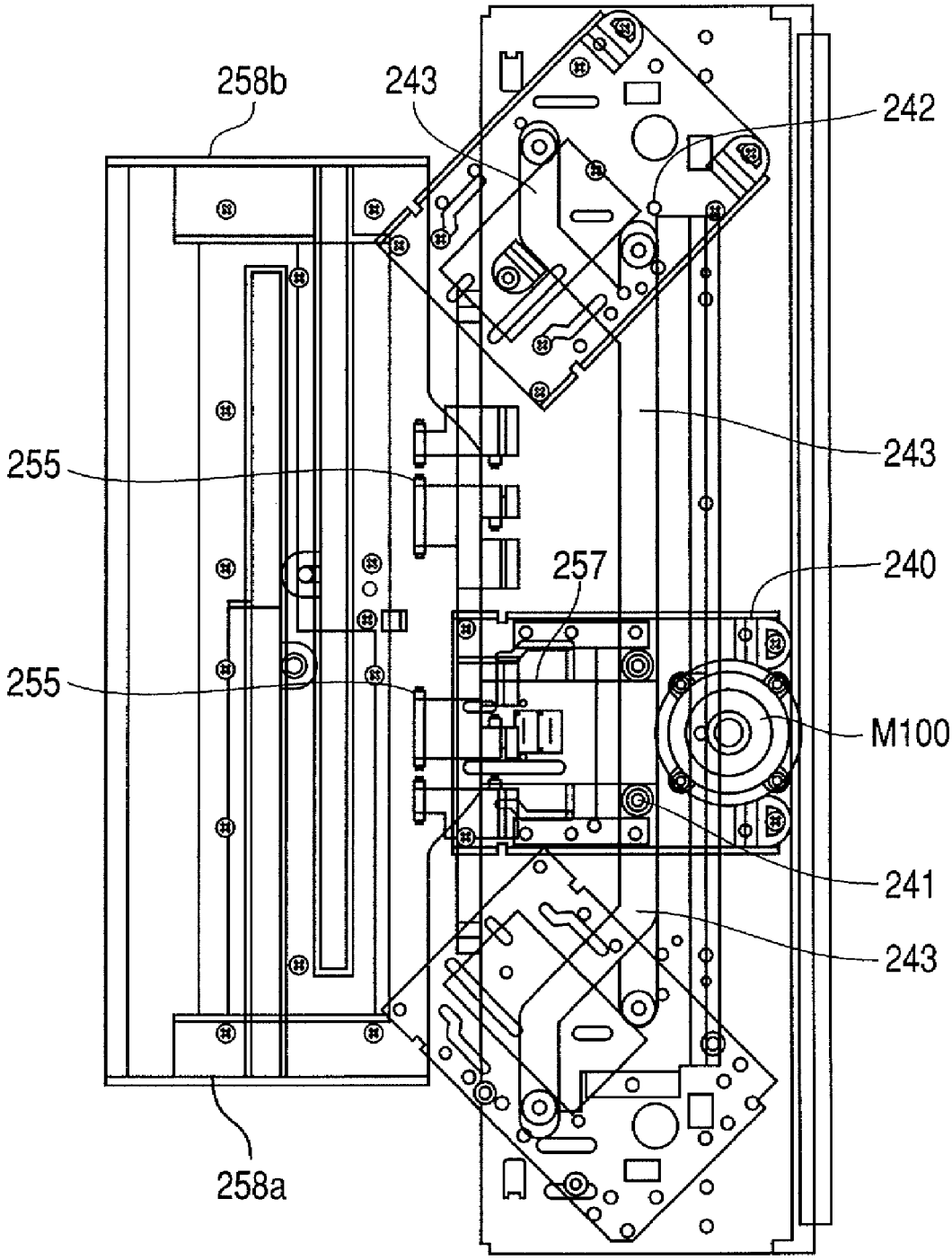
FIG. 5 is a diagram showing a moving mechanism of a stapler provided for the sheet processing apparatus.

FIG. 5 is a diagram showing a moving mechanism of the stapler 257. Belt pulleys 241, rollers (not shown), and a pinion gear (not shown) are integratedly formed to a moving base plate 240 on which the stapler 257 has been put. The pinion gear is coupled with a stapler motor M100 fixed to the moving base plate 240. A rack gear 242 adapted to be come into engagement with the pinion gear along a rail hole 243 is fixed to a lower surface of the moving base plate 240. The stapler 257 is moved integratedly with the moving base plate 240 by the rack gear 242 and the pinion gear in association with the forward/reverse rotation of the stapler motor M100.

Figure 6:
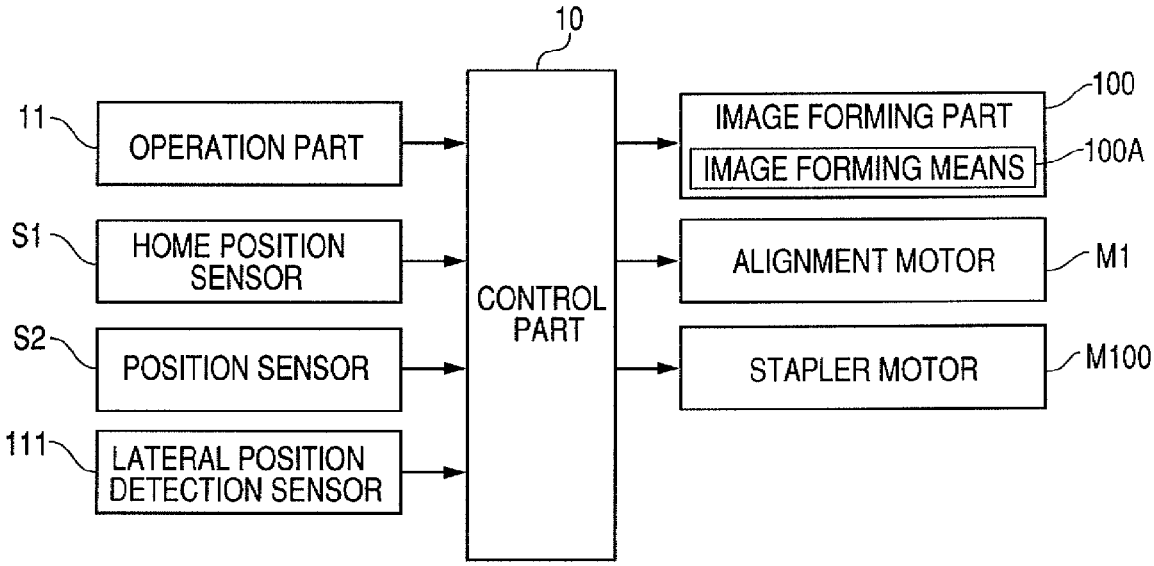
FIG. 6 is a diagram showing a part of a control block of the copying apparatus.

Ordinarily, on the basis of a signal from a home position sensor S1, the control portion 10 shown in FIG. 6 controls the stapler motor M100 so that the stapler 257 enters a standby mode at a home position (frontmost portion in the embodiment).

Subsequently, the sheet is conveyed to the second sort conveying path 252 shown in FIG. 1 by the change-over of the change-over flapper and, thereafter, ejected to a processing tray 254 constructing a stacking portion by a second ejecting portion 253 as an ejecting portion. Further, the ejected sheet is conveyed in the direction of a rear edge stopper 255 by a tare weight of the ejected sheet and a paddle 271 shown in FIG. 4 and serving as a press member.

The paddle 271 is constructed by attaching blades 271*b* as elastic members to two positions of a paddle axis 271*a* which is driven by a motor MP. An axial end on the side opposite to the motor MP of the paddle axis 271*a* can be moved by a solenoid (not shown) to the following two positions: a position where the conveying direction of the paddle 271 becomes a direction shown by an arrow D; and a position where it becomes a direction shown by an arrow D' shown in FIG. 10, which will be explained hereinafter.

Since an axial end of the motor side of the paddle axis 271*a* has been connected to the motor MP through a coupling (not shown), even if the axial end on the opposite side is moved to the two positions by the activation of the solenoid as mentioned above, the paddle 271 can rotate.

Figure 7:
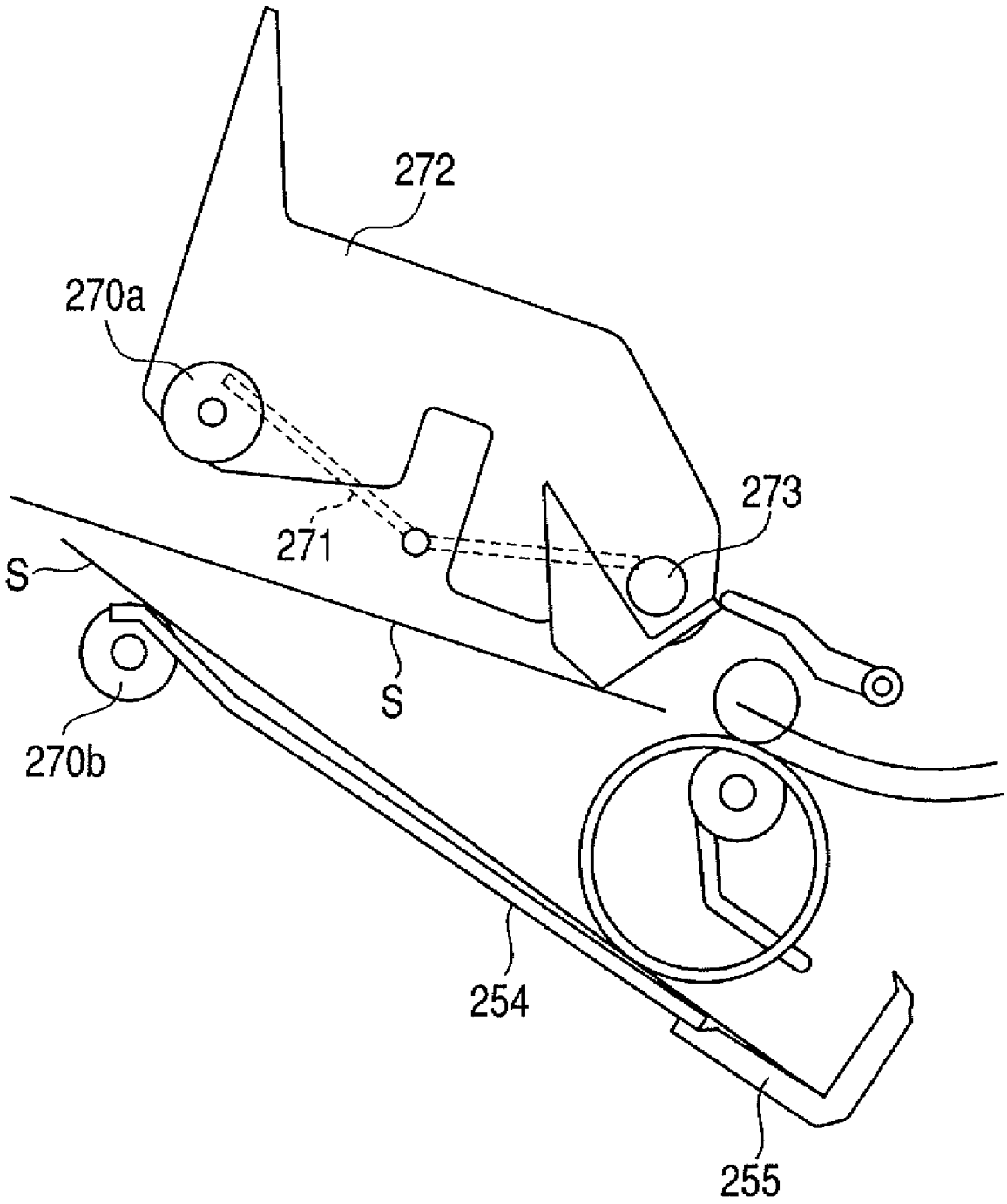
FIG. 7 is a side elevational view of the binding part of the sheet processing apparatus.

Generally, the paddle 271 is controlled so as to be located to such a home position that it is almost parallel with the processing tray 254 as shown in FIG. 7 by a flag (not shown) attached to the paddle axis 271*a* so that the paddle 271 does not obstruct the discharge of the sheet to the processing tray 254.

In FIG. 7, reference numeral 272 denotes a swinging guide for rotatably holding an upper bundle ejecting roller 270*a* constructing a pair of bundle ejecting rollers 270. The swinging guide 272 swings around a swinging axis 273 as a fulcrum by the activation of a rotary cam (not shown) connected to a swinging motor (not shown). When the sheet is ejected onto the processing tray 254, the swinging guide 272 swings upward, thereby allowing the bundle ejecting roller pair 270 to be away from each other. When the sheet bundle is ejected as will be explained hereinafter, the swinging guide 272 swings downward, thereby allowing the sheet bundle to be sandwiched by the bundle ejecting roller pair 270 and conveyed.

By allowing the bundle ejecting roller pair 270 to be away from each other in this manner, it is prevented that the bundle ejecting roller pair 270 becomes an obstacle to the ejection of the sheet S to the processing tray 254 and the alignment of the sheets.

Subsequently, the sheet S conveyed in the direction of the rear edge stopper 255 by the paddle 271 shown in FIG. 4 collides with the rear edge stopper 255 provided on the downstream side in the conveying direction of the processing tray 254, so that the alignment in the conveying direction is made. After that, the alignment in the width direction is made by a pair of aligning plates 258*a* and 258*b*.

The aligning plates 258*a* and 258*b* serving as aligning members are arranged in such a manner that the aligning surfaces on their upper surface sides face the processing tray 254. The aligning plates 258*a* and 258*b* are assembled in such a manner that the rack gear part is movable in the aligning direction through a set of guide grooves (not shown) which are formed on the lower surface side of the processing tray 254 and extend in parallel in the sheet width direction.

The pinion gear which is forwardly/reversely rotated by an alignment motor M1 which is forwardly/reversely rotated under control of the control portion 10 shown in FIG. 6 in accordance with a processing mode, which will be explained hereinafter, is come into engagement with each rack gear. By the forward/reverse rotation of the alignment motor M1, the aligning plates 258*a* and 258*b* are movable in the aligning direction through the rack gear and the pinion gear. In the embodiment, the aligning plates 258*a* and 258*b* are constructed in such a manner that when the sheets are aligned, one of the aligning plates 258*a* and 258*b* is fixed as an alignment reference and the other is moved in one direction, thereby aligning the sheets.

A position sensor S2 shown in FIG. 6 for detecting the home position of each aligning plate is arranged for each of the aligning plates 258*a* and 258*b* which can be independently driven. On the basis of signals from the position sensors S2, generally, the control portion 10 controls the alignment motor M1 in such a manner that the aligning plates 258*a* and 258*b* are located at their home positions where they do not obstruct the ejection of the sheet S to the processing tray 254 shown in FIG. 4.

After the sheets S which are sequentially stacked onto the processing tray 254 are aligned by the aligning plates 258*a* and 258*b* constructed as mentioned above, they are stapled by the stapler 257 at one position of the front side.

When the sheet bundle is stapled, the swinging guide 272 shown in FIG. 7 is swung downwardly, thereby allowing the sheet bundle to be sandwiched by the bundle ejecting roller pair 270. Thus, upon executing the stapling process, it is possible to prevent an upper layer portion of the sheets from being deviated. After that, the sheet bundle is ejected onto a sort tray 281 by driving the bundle ejecting roller pair 270.

In the embodiment, if the staple sort processing mode at one position of the front side has been selected, the aligning plate (hereinbelow, referred to as a first aligning plate) 258*a* close to the stapler 257 has been fixed as a reference wall upon aligning. The other aligning plate (hereinbelow, referred to as a second aligning plate) 258*b* is movable in such a direction as to approach or be away from the aligning plate (258*a* in this example). After the sheet reaches the rear edge stopper 255, when the movable second aligning plate 258*b* is moved in the direction of the first aligning plate 258*a* functioning as a reference wall, the sheet S is pressed against the first aligning plate 258*a*, so that the position of the sheet S in the width direction is aligned.

Further, in the embodiment, the conveying direction of the paddle 271 is a direction which is inclined from the rear edge stopper 255 by a predetermined angle (5° in the embodiment) as shown by the arrow D in FIG. 4. The sheet S is conveyed in the direction of the first aligning plate 258*a* functioning as a reference wall.

Figure 8A:
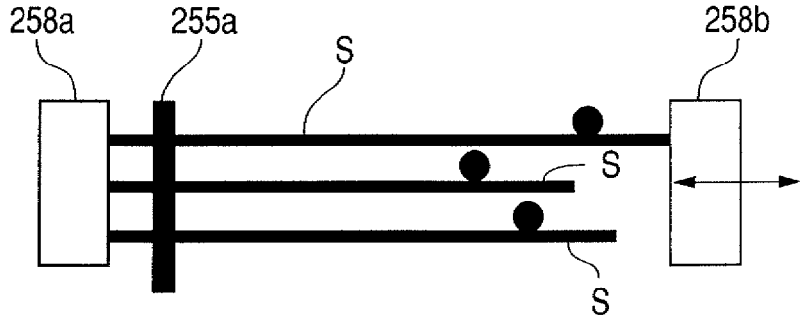
FIGS. 8A, 8B, and 8C are diagrams showing a state of sheets aligned on a processing tray in the staple sort processing mode at one position of the front side of the sheet processing apparatus.

Upon image creation, there is a case where in the lateral position detection sensors 111*a* and 111*b* shown in FIG. 2, the sheet edge portion is detected by using the lateral position detection sensor 111*b* of the rear side and the image is formed so that the image area edge portions from the edge portions of the sheets coincide. In this case, in the staple sort processing mode at one position of the front side, if the sheets are conveyed in the direction of the first aligning plate 258*a* and aligned on the processing tray 254, the aligned sheets S are as shown in FIG. 8A. Reference numeral 255*a* denotes a staple needle.

Figure 8B:
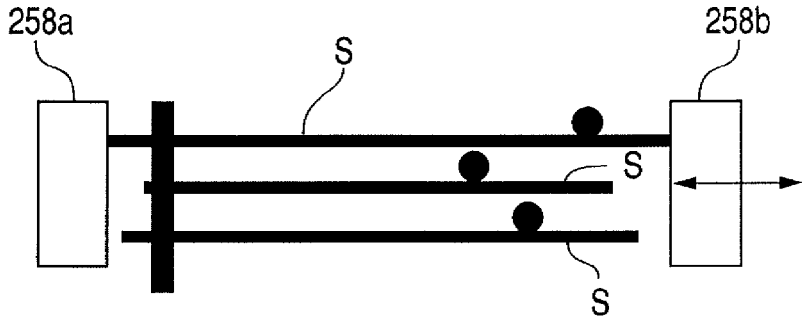
Figure 8C:
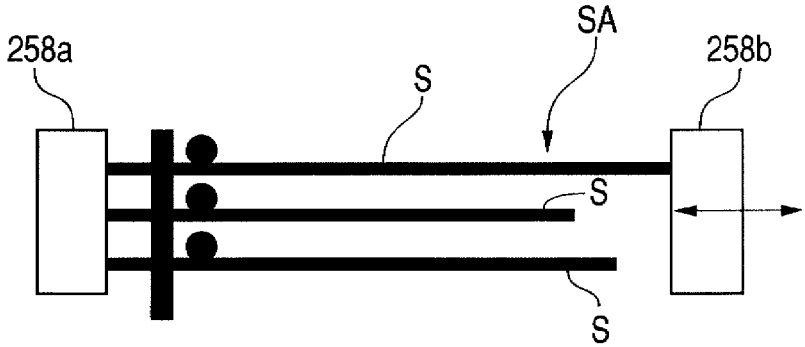

FIGS. 8A to 8C show the state of the sheets S aligned by the aligning plates 258*a* and 258*b* when seen from the direction shown by an arrow E in FIG. 2. In the diagrams, the image area edge portions formed at the positions which are away from the edge portions of the sheets by a predetermined amount are shown by black dots.

In the state shown in FIG. 8A, it will be understood that the sheets aligned on the processing tray 254 have tightly been pressed onto the first aligning plate 258*a* by the paddle 271. As for the reference of the image area edge portion, since the right edge of the sheet has been detected by the lateral position detection sensor 111*b* of the rear side as already mentioned above, it will be understood that the edge portions of the image areas from the sheet edge portions of all of the sheets coincide.

However, it will be understood that if the sheets have been expanded or contracted, there are differences among the image area edge portions of the stapled sheet bundle in dependence on the sheets as shown in FIG. 8A. In other words, it will be understood that even if the image area edge portions for the sheet edge portions are aligned in the copying apparatus main body 1A, a variation in the image area edge portions in the system also including the sheet processing apparatus 2 has to be considered.

In the sheet processing apparatus 2, if the paddle 271 for obliquely conveying the sheet does not exist, since the sheets cannot be tightly pressed onto the aligning plate 258*a*, a variation in the image area edge portions occurs as shown in FIG. 8B. Further, the staple needle 255*a* cannot be inserted at a position away from the side edge of the sheet by a predetermined distance and the proper binding process cannot be executed.

In the embodiment, therefore, in order to enable the sheets to be bound (processed) without a variation in the image area edge portions even if the sheets have been expanded or contracted, in the case of executing the stapling process at one position of the front side, the sheet edge portions are detected by using the lateral position detection sensor 111*a* of the front side.

An influence which is exerted by the sheet expansion/contraction on the distance from the reference side edge portion of the sheet to the image area edge portion of the reference side is fairly smaller than an influence which is exerted on the distance from the opposite side edge portion of the sheet to the same image area edge portion of the reference side. Therefore, in the reference side edge portions of the alignment and the sheet process, the reference side image area edge portions of the sheets can be almost aligned. With such a construction, even if the paddle 271 is not provided, the variation in the image area edge portions can be suppressed. However, it is more preferable to provide the paddle 271 in order to align the image area edge portions at higher precision.

Such a sheet processing apparatus 2 will now be described with reference to a flowchart shown in FIG. 9.

In this case, if the staple processing mode is chosen by the operation portion 11 (Yes in step S101) and, further, the stapling process at one position of the front side is chosen as a stapling process (Yes in S103), first, the stapler 257 is preliminarily moved to the position shown in FIG. 4 (S105). Subsequently, the lateral position detection sensor 111*a* of the front side in which the position of the sheet width direction is the same as that of the first aligning plate 258*a* is chosen (S107). After that, the system activation is started (S109). Thus, the creation of the image is started from the front side of the sheet.

In the case of executing the stapling process at one position of the front side in this manner, the sheet edge portion is detected by using the lateral position detection sensor 111*a* of the front side in which the position of the sheet width direction is the same as that of the first aligning plate 258*a* and the image is formed so that the image area edge portions from the front side edges of the sheets coincide. Thus, the sheets aligned on the processing tray 254 become as shown in FIG. 8C.

When seeing FIG. 8C, the sheets aligned on the processing tray 254 have tightly been pressed onto the aligning plate 258*a* of the reference side by the paddle 271. As for the reference of the image area edge portion, since the right edge of the sheet in the diagram has been detected by the lateral position detection sensor 111*a* of the front side, the edge portions of the image areas from the sheet edge portions (right side in the diagram) of all of the sheets almost coincide.

Moreover, it will be understood that even if there is a small amount of sheet expansion/contraction, there is little difference among the image area edge portions of a stapled sheet bundle SA. That is, the variation in the image area edge portions of the sheets in which the alignment of the image area edge portions to the sheet edge portions has been performed at high precision in the copying apparatus main body 1A can be suppressed in the system also including the sheet processing apparatus 2.

The case where the staple sort processing mode at one position of the rear side has been chosen in such a sheet processing apparatus 2 will now be described.

Figure 10A:
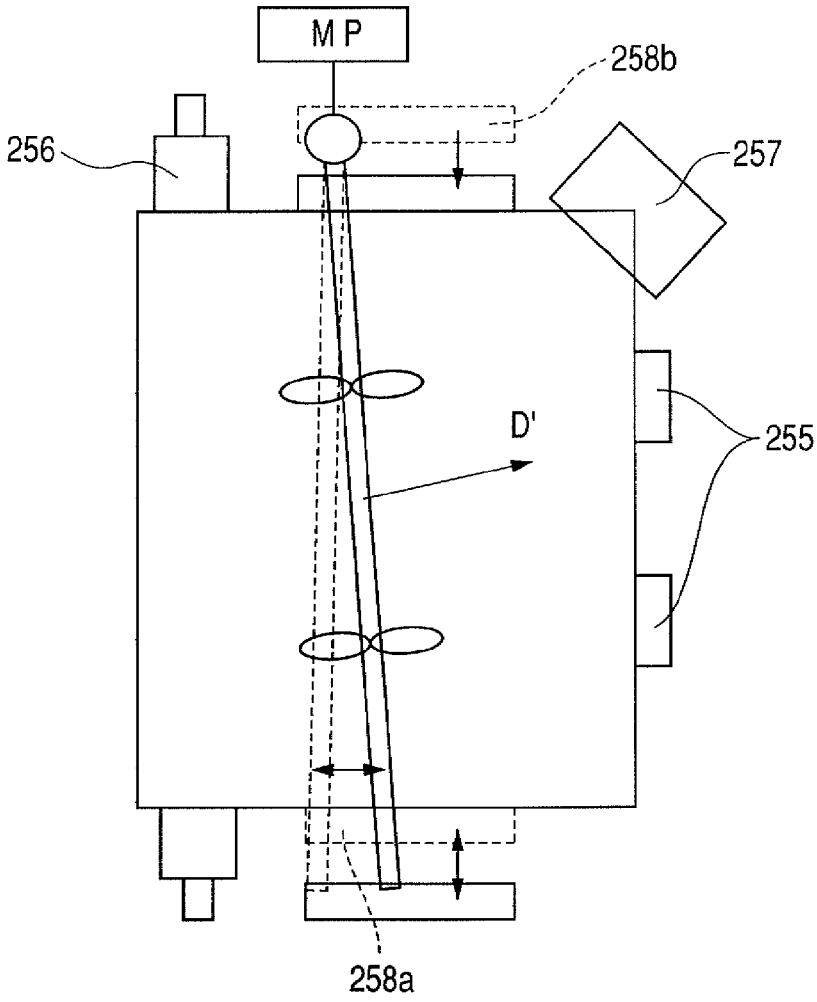
FIGS. 10A and 10B are diagrams showing a state of the sheets aligned on the processing tray in the staple sort processing mode at one position of the rear side of the sheet processing apparatus.

When the staple sort processing mode at one position of the rear side is chosen, the stapler 257 in the sheet processing apparatus 2 is preliminarily moved to a position shown in FIG. 10A. A change-over flapper (not shown) is switched so that the sheet S ejected from the copying apparatus main body 1A is allowed to pass through the first sort conveying path 250 from the inlet roller 201 shown in FIG. 1 and can be guided to the second sort conveying path 252.

Thus, the sheet is conveyed to the second sort conveying path 252 and, thereafter, ejected to the processing tray 254 by the second ejecting portion 253. Further, the ejected sheet is conveyed in the direction of the rear edge stopper 255 by the tare weight and the paddle 271.

In the case of the staple sort processing mode at one position of the rear side, the first aligning plate 258*a* is set to be movable and the second aligning plate 258*b* is fixed in a manner opposite to that in the staple sort processing mode at one position of the front side. Thus, after the sheet reached the rear edge stopper 255, when the movable first aligning plate 258*a* is moved in the direction of the second aligning plate 258*b* functioning as a reference wall, the sheet S is pressed to the second aligning plate 258*b* and the position of the sheet S in the width direction is aligned.

The axial edge of the paddle axis 271*a* on the side opposite to the motor MP is moved counterclockwise by a solenoid (not shown). Thus, the conveying direction of the paddle 271 becomes a direction which is inclined from the rear edge stopper 255 by a predetermined angle (−5° in the embodiment) as shown by the arrow D' in FIG. 10A. Thus, the sheet S is conveyed in the direction of the second aligning plate 258*b* functioning as a reference wall.

Figure 9:
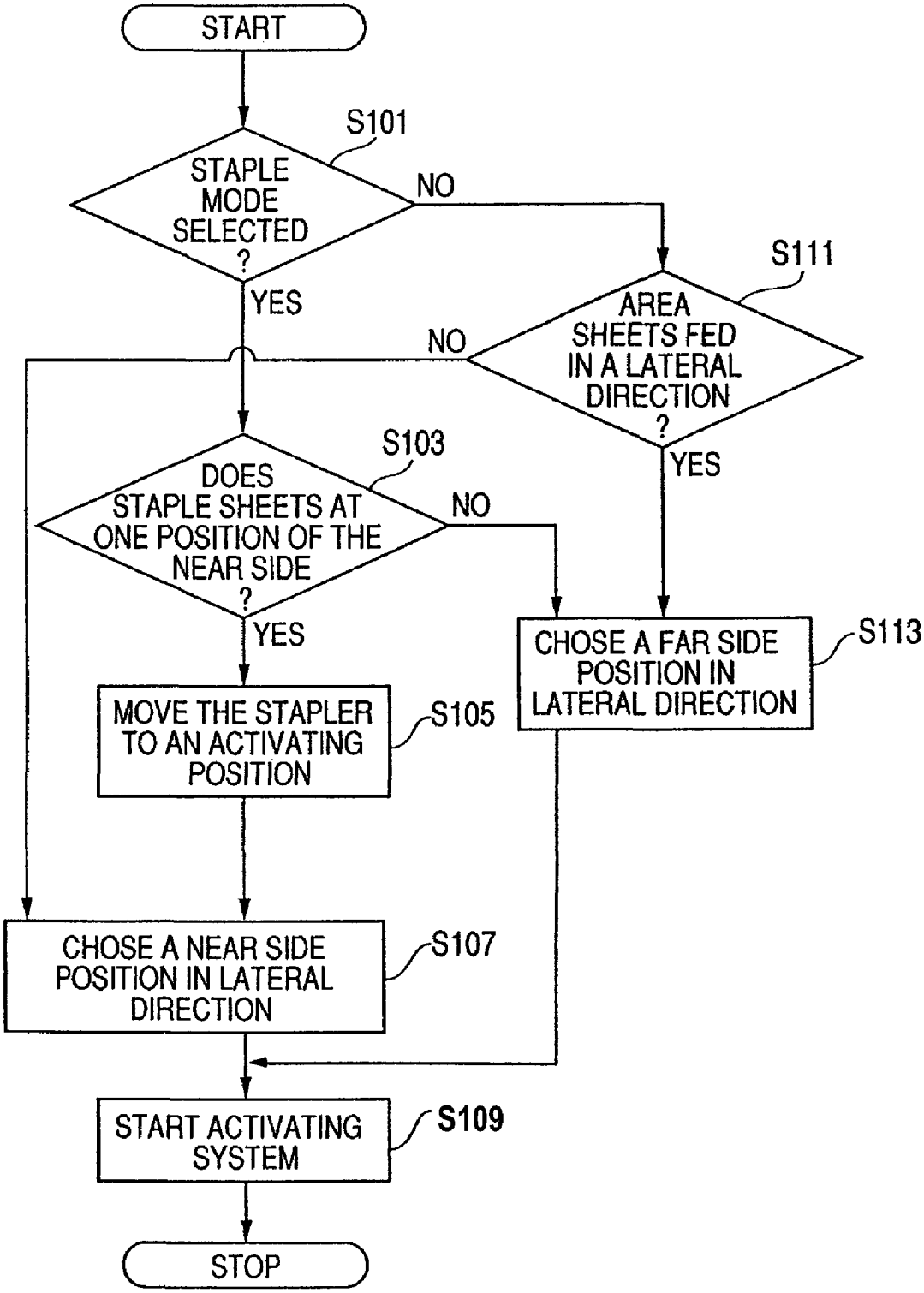
FIG. 9 is a flowchart for explaining the staple sort processing mode at one position of the front side and a staple sort processing mode at one position of the rear side of the sheet processing apparatus.

Further, as shown in the flowchart of FIG. 9, if the stapling process at one position of the rear side is chosen as a stapling process (No in S103), the lateral position detection sensor 111*b* of the rear side in which the position of the sheet width direction is the same as that of the second aligning plate 258*b* functioning as a reference wall is chosen (S113). After that, the system activation is started (S109). Thus, the creation of the image is started from the rear side of the sheet. However, in the case of using a polygon mirror (rotary polygon mirror) as a device for irradiating light onto the photosensitive drum 102 in accordance with the image signal, it is necessary to reversely rotate the polygon mirror in order to form the image from the rear side of the sheet. Sensors for detecting a writing start position have to be provided on both of the front and rear sides. In this case, the rear side edge portion of the image data area is arithmetically operated on the basis of the writing position and a width A of image data area of the sheet S shown in FIG. 2 and used as a reference for creation of the image of the rear side.

Figure 10B:
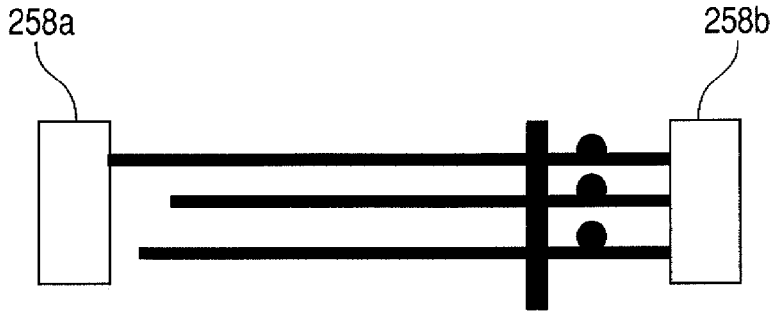

By selecting the lateral position detection sensor 111*b* of the rear side, detecting the sheet edge portions, and forming the image so that the image area edge portions from the rear side edges of the sheets coincide as mentioned above, the sheets aligned on the processing tray 254 become as shown in FIG. 10B.

When seeing FIG. 10B, the sheets aligned on the processing tray 254 have tightly been pressed onto the second aligning plate 258*b* by the paddle 271. As for the reference of the image area edge portion, since the right edge of the sheet in the diagram has been detected by the lateral position detection sensor 111*b* of the rear side, the edge portions of the image areas from the sheet edge portions (right side in the diagram) of all of the sheets almost coincide.

Moreover, it will be understood that even if there is a small amount of sheet expansion/contraction, there is little difference among the image area edge portions of the stapled sheet bundle. That is, the variation in the image area edge portions of the sheets in which the alignment of the image area edge portions to the sheet edge portions has been performed at high precision in the copying apparatus main body 1A can be suppressed in the system also including the sheet processing apparatus 2. In a manner similar to the foregoing staple sort processing mode at one position of the front side, this is because the influence which is exerted by the sheet expansion/contraction on the distance from the reference side edge portion of the sheet to the image area edge portion of the reference side is fairly smaller than the influence which is exerted on the distance from the opposite side edge portion of the sheet to the same image area edge portion of the reference side.

The case where a staple sort processing mode at two positions has been chosen in such a sheet processing apparatus 2 will now be described.

Figure 11A:
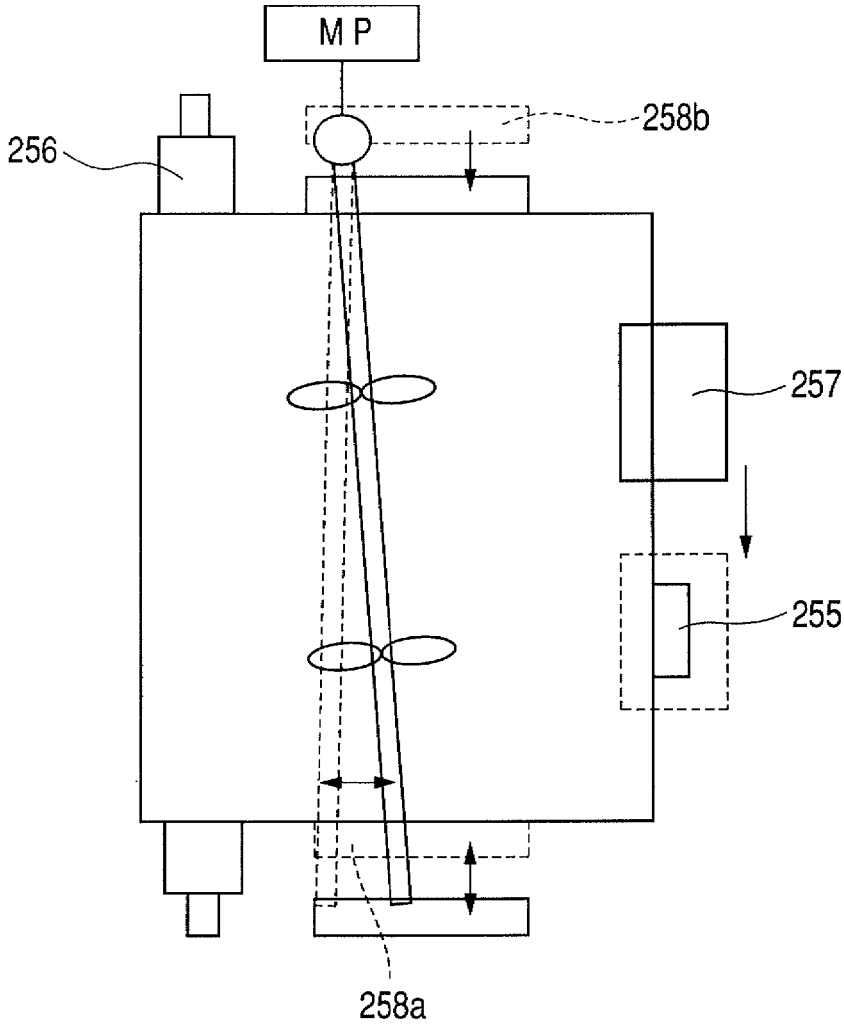
FIGS. 11A and 11B are diagrams showing a state of the sheets aligned on the processing tray in a staple sort processing mode at two positions of the sheet processing apparatus.

In this case, the stapler 257 in the sheet processing apparatus 2 is preliminarily moved to a position shown by a solid line in FIG. 11A. The change-over flapper (not shown) is switched so that the sheet S ejected from the copying apparatus main body 1A is allowed to pass through the first sort conveying path 250 from the inlet roller 201 shown in FIG. 1 and can be guided to the second sort conveying path 252.

Thus, the sheet is conveyed to the second sort conveying path 252 and, thereafter, ejected to the processing tray 254 by the second ejecting portion 253. Further, the ejected sheet is conveyed in the direction of the rear edge stopper 255 by the tare weight and the paddle 271. After that, the staple operation is executed at the solid line position shown in FIG. 11A. After the staple operation is finished, the stapler 257 is moved to the second position shown by a dotted line portion and the sheet bundle is stapled at the second position.

In the staple sort processing mode at two positions, the lateral position detection sensor 111*b* of the rear side is fundamentally used as a reference. This is because it is intended to perform the alignment of the image area edge portions at high precision by using the upper portion of the stapled sheets as a reference. In this instance, the sheets aligned on the processing tray 254 are as shown in FIG. 11B.

Figure 11B:
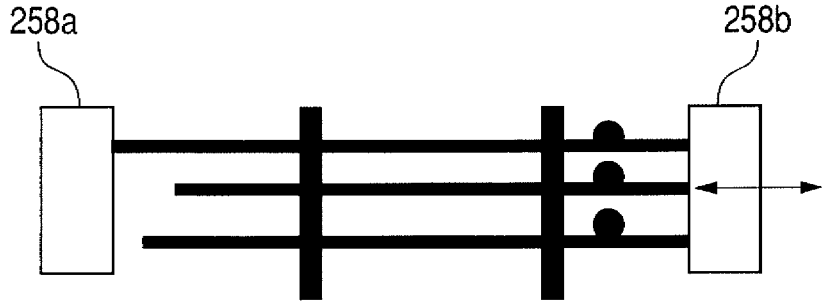

Referring to FIG. 11B, the sheets aligned on the processing tray 254 have tightly been pressed to the aligning plate 258*b* by the paddle 271. As for the reference of the image area edge portion, since the right edge of the sheet in the diagram has been detected by the lateral position detection sensor 111*b* of the rear side, the edge portions of the image areas from the sheet edge portions (right side in the diagram) of the reference side of all of the sheets almost coincide.

Moreover, it will be understood that even if there is a small amount of sheet expansion/contraction, there is little difference among the image area edge portions of the stapled sheet bundle. That is, the variation in the image area edge portions of the sheets in which the alignment of the image area edge portions to the sheet edge portions has been performed at high precision in the copying apparatus main body 1A can be suppressed in the system also including the sheet processing apparatus 2.

That is, in the embodiment, an object to hold the image area edge portions of the sheet bundle at high precision can be realized by using the lateral position detection sensor 111*b* of the side of the second aligning plate 258*b* of the sheet processing apparatus 2. In the case where the first aligning plate 258*a* has been fixed in accordance with the kind of image to be formed, the image area edge portions can be also aligned to the lower side reference of the sheet bundle by using the lateral position detection sensor 111*a* of the front side.

The case where the sort processing mode has been selected in the sheet processing apparatus 2 as mentioned above will now be described. The sort processing mode is a mode in which the sheet bundles which have been subjected only to the alignment without being subjected to the binding process are shifted to different positions in the direction which perpendicularly crosses the sheet conveying direction and sorted.

If the sort processing mode has been selected by the operation portion 11, the stapler 257 of the sheet processing apparatus 2 is held in the standby mode at the home position which does not overlap the sheet bundle. The change-over flapper (not shown) is switched so that the sheet S ejected from the copying apparatus main body 1A is allowed to pass through the first sort conveying path 250 from the inlet roller 201 shown in FIG. 1 and can be guided to the second sort conveying path 252.

The operation of the sheet is almost similar to that described before (in the staple sort processing mode at one position of the front side) except that only the operation regarding the staple operation does not exist. The lateral position detection sensor 111*b* is used as a default in a manner similar to the staple sort processing mode at two positions.

When the sheet is vertically being fed, the lateral position detection sensor 111*a* is used as a default. This means that under the using conditions of the stapled sheet bundle, the upper (upper side) lateral position detection sensor 111*a* is used as a reference side.

The case where a saddle stitch mode as a processing mode in which almost the center portion of the sheet bundle is stapled and, thereafter, folded into half and booklet-bound has been selected in such a sheet processing apparatus 2 will now be described.

In this case, the sheet S ejected from the copying apparatus main body 1A is allowed to pass through a saddle stitch path 202 from the inlet roller 201 shown in FIG. 1 by the change-over flapper (not shown) and ejected to an aligning portion 203 for saddle-stitching by a third ejecting portion 215. After that, a front edge of the sheet in the sheet conveying direction is come into contact by a stopper 207. Subsequently, the sheet width direction is aligned by a pair of aligning plates 219 as aligning members in the sheet width direction. Such an aligning process is executed the number of times corresponding to the set number of print copies.

In this instance, in order to enable the next sheet to be ejected to the left side in the diagram of the sheets which have already been stacked in the aligning portion 203, the third ejecting portion 215 is arranged to the left of the aligning portion 203 and the aligning portion 203 is inclined to the right in the diagram. Thus, the ejected sheet and the sheets which have already been stacked are not interfered with each other.

Subsequently, after the alignment of the set number of print copies was finished in the aligning portion 203, if the stapling process has been set the sheets are stapled by two staplers 204 for stapling almost the center portion in the sheet conveying direction of the aligned sheets. The staplers 204 are arranged in such a manner that the stapler main body (not shown) is located to the right side in the diagram of the aligning portion 203 and an anvil portion (not shown) is located to the left side in the diagram of the aligning portion 203 so that the needle legs are directed toward the folding roller pair.

Subsequently, the stopper 207 which is downwardly movable is activated in the downstream direction by a predetermined amount in accordance with a sheet size and the sheet bundle is conveyed until almost the center portion in the sheet conveying direction (staple portion in the case where the stapling process has been executed) reaches a position near a nip of a folding roller pair 205. After that, by activating a plate 206 with a sheet in the direction of the nip portion of the folding roller pair 205, the sheet is folded into half in almost the center portion in the conveying direction.

Also in this case, the lateral position detection sensor 111*b* is fundamentally used in a manner similar to the staple sort processing mode at two positions. This is because if it is intended to staple the center portion of the original at two positions, as for the upper portion of the sheets, the sheet which is ejected in a face-down state in the image forming apparatus 1 by a head page process comes to the upper side in FIG. 2, and in this instance, it is intended to raise the precision of the image area edge portions by using the upper portion of the stapled sheets as a reference.

As described above, when the image is formed onto the sheet, the side edge of the sheet of the side which is come into contact with the aligning member of the side fixed as a reference wall upon aligning is used as a reference and the image is formed. Thus, when the sheet is processed, the image area edge portions can be aligned at high precision. Although the embodiment has been described with respect to the stapling process as an example of the sheet process which is executed after the alignment, a punching process may be executed as another process. By forming the image by using the side edge, as a reference, of the sheet of the side which is come into contact with the aligning member of the reference side upon aligning, in the case of holding the sheets by using the punch holes, an attractive state where the image area edge portions are aligned is obtained.

Second Embodiment

In the copying apparatus (image forming apparatus), there is an apparatus constructed in such a manner that after the toner image formed on the photosensitive drum 102 was temporarily transferred onto an intermediate transferring member, the toner image transferred onto the intermediate transferring member is secondarily transferred onto the sheet.

The copying apparatus according to the second embodiment of the invention as mentioned above differs from the copying apparatus according to the foregoing first embodiment with respect to a point that the intermediate transferring member (not shown) exists between the photosensitive drum 102 and the transferring portion 104.

In the image forming apparatus with such a construction according to the second embodiment, a distance until the transfer image is secondarily transferred onto the sheet after the image was transferred onto the intermediate transferring member is long. Therefore, in the case where the image is formed in accordance with the position of the sheet, for example, if the image creation is not started before the sheet is fed from the feed cassette 145, the image creation is not in time. Therefore, in such an image forming apparatus, it is necessary to align the positions of the sheets in accordance with the edge portion of the image area.

Therefore, the registration roller 110 is shifted so that the sheet is located to a predetermined position on the basis of a detection result obtained by either the lateral position detection sensor 111*a* of the front side or the lateral position detection sensor 111*b* of the rear side in accordance with the sheet size and the sheet processing mode.

In this instance, for example, the sheet rear side edge is aligned to the reference position of the lateral position detection sensor 111*b* of the rear side serving as a reference side of the aligning and sheet processes (in this case, the position of the sheet rear side edge at the position where the sheet width center coincides with the center portion in the width direction of the photosensitive drum 102).

If an output value from the lateral position detection sensor 111*b* when the sheet has reached the lateral position detection sensor 111*b* as a line sensor is equal to a value showing that the sheet is located on the rear side than the reference position, the registration roller 110 is shifted to the reference position in the front direction. If a value showing that the sheet is located on the front side of the reference position is outputted from the lateral position detection sensor 111*b* of the rear side, the registration roller 110 is shifted to the reference position in the rear direction.

Thus, the passing position in the main-scanning direction of the sheet S conveyed from the registration roller 110 is detected by the lateral position detection sensors 111*a* and 111*b*. After that, while conveying the sheet S, the registration roller 110 shifts the sheet S to almost the center portion in the main-scanning direction on the basis of the detection information from the lateral position detection sensors 111*a* and 111*b*. Thus, the deviation in the lateral direction of the sheet S can be corrected and the sheet S can be positioned into the image writing area.

By constructing the apparatus as mentioned above, the position of the sheet can be aligned with the edge portions of the image area and, when the sheet is processed, the image area edge portions can be aligned to the reference side of the sheet process at high precision.

Figure 12:
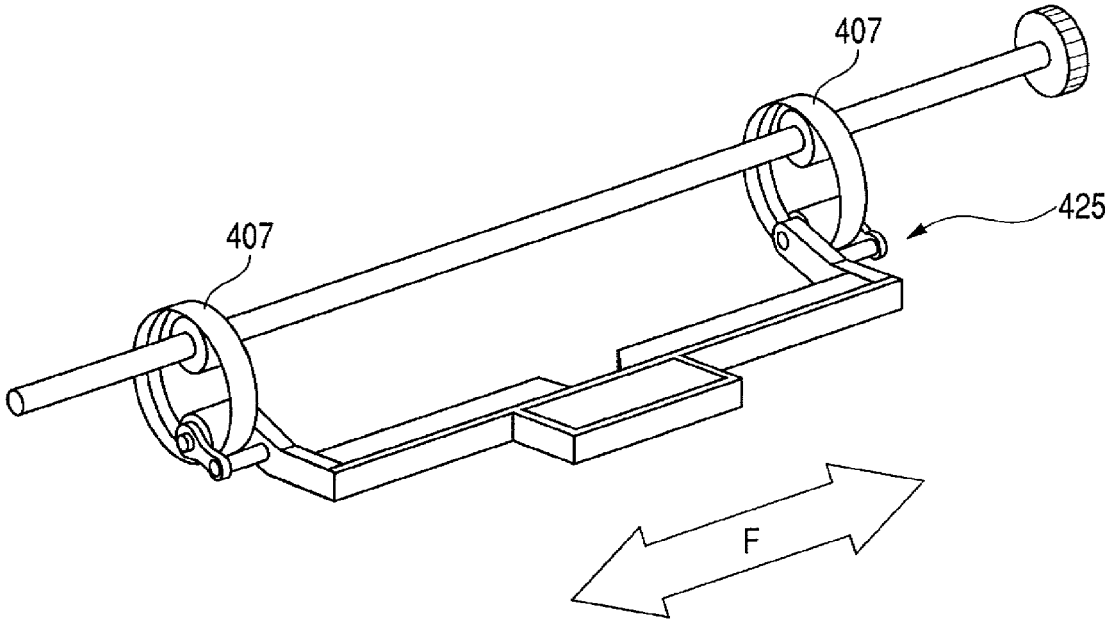
FIG. 12 is a perspective view showing a construction of a knurling unit which is provided for the sheet processing apparatus and presses the sheet to an aligning plate.
Figure 13:
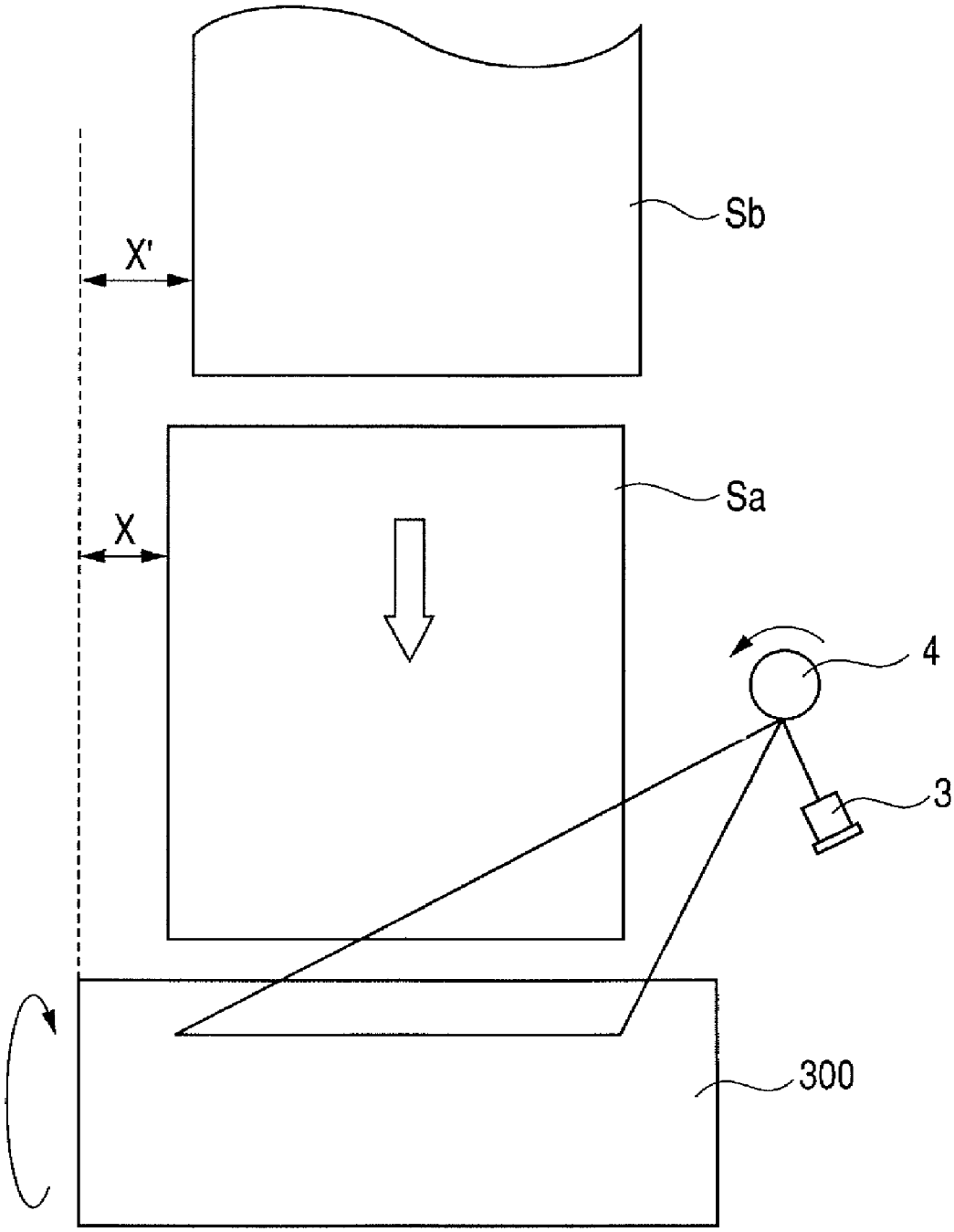
FIG. 13 is a plan view showing a construction of an image forming portion of a conventional image forming apparatus.

Although the paddle 271 has been used as a press member for pressing the sheet to the aligning plates in the above explanation, a knurling unit 425 having knurling belts 407 as elastic members can be also used as shown in FIG. 12.

In the case of pressing the sheet to the aligning plates by such a knurling unit 425, as shown by arrows F in FIG. 12, the knurling unit 425 is moved by using a solenoid or motor (not shown), thereby obliquely feeding the sheet. Thus, an effect similar to that in the case of using the paddle 271 can be obtained.

Although the case of the stapling process has been explained above, even in another processing mode such as a punching mode or the like, the variation of the image area edge portions can be suppressed by using the lateral position detection sensor 111 in the same direction as that of the reference side of an aligning plate 258.

Even when a plurality of sheets are cut by an offline cutter on the basis of a register mark image which is used to cut the sheets, if the lateral position detection sensor 111 on the side where the sheets are allowed to collide with the cutter is used, the image area edge portions of all of the sheets are aligned to almost the same position. Thus, the variation of the image area edge portions upon cutting can be suppressed.

Although the embodiment has been described with respect to the case where the two lateral position detection sensors are arranged, a similar effect can be also obtained by using one lateral position detection sensor larger than the sheet width of the largest size. Further, although the registration correction has been made by using the registration roller 110, a similar effect can be obtained even by using another construction in which, for example, the oblique motion of the sheet is corrected by conveying the sheet at difference speeds by using two independent motors. Moreover, the shift of the image data and the shift of the sheet can be also simultaneously performed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-360297, filed Dec. 14, 2005, which is hereby incorporated by reference herein in its entirety.

What is claimed is:

1. An image forming apparatus comprising:

an image forming portion which forms an image on a sheet;

a control portion which controls said image forming portion; and a sheet processing apparatus which processes sheets on which images are formed after aligning sheets, wherein said sheet processing apparatus includes:

a stacking portion which stacks sheets on each of which an image is formed;

a sheet conveying portion which conveys the sheets to said stacking portion;

a pair of aligning members which are configured to face with each other, and movable independently to align edge portions of the sheet stacked in said stacking portion along a sheet conveying direction; and a binding part which selectively performs a binding process at one of the edge portions of the sheets aligned by said pair of aligning members, wherein said control portion selects one of the edge portions of the sheets to be bound by said binding part from the edge portions of the sheets along the sheet conveying direction, and selects one of said pair of aligning members at the side of the one of the edge portions to be bound as a reference of the alignment, while the other of said pair of aligning members presses the sheets against the one of aligning members, and wherein said control portion controls said image forming portion so that the one of the edge portion of the sheet selected at the side of the one of said pair of aligning members to be selected as the reference of the alignment is determined as a reference of the image to be formed.

2. An image forming apparatus according to claim 1, further comprising:

a side edge detection portion provided upstream of said image forming portion, said side edge detection portion detecting position of the side edge of the sheet to be abutted against said one of said aligning member, wherein on a basis of signals from said side edge detection portion, said control portion controls said image forming portion.

3. An image forming apparatus according to claim 2, further comprising:

an image memory which stores image data, wherein said control portion changes an image forming position based on the edge of the sheet by shifting a position of an area of the image data in an image writing area in said image memory.

4. An image forming apparatus according to claim 2, wherein said stacking portion has a press member which presses the sheets against the one of said aligning members chosen as the reference of the alignment.

5. An image forming apparatus according to claim 2, wherein said side edge detection portion has sensors configured to face with each other provided upstream of said image forming portion in the sheet conveying direction so as to respectively detect positions of both side edges in a direction perpendicular to the sheet conveying direction.

6. An image forming apparatus according to claim 2, wherein said side edge detection portion is provided upstream of said image forming portion in the sheet conveying direction, and extends in the direction perpendicular to the sheet conveying direction by a length in which said side edge detection portion is capable of detecting positions of both side edges of the sheet in the direction perpendicular to the sheet conveying direction.

7. An image forming apparatus according to claim 5, wherein said side edge detection portion is a contact type line sensor.

8. An image forming apparatus according to claim 1, wherein said stacking portion has a press member which presses the sheets against the one of said aligning members.

9. An image forming apparatus according to claim 1, wherein:

said binding part has a stapler, said stapler stapling the sheets stacked in said stacking portion, and said stapler staples the edge portions of the sheets on the side of the sheet edges which abut against the one of said aligning members.

10. An image forming apparatus according to claim 1, further comprising:

a side edge detection portion provided upstream of said image forming portion in the sheet conveying direction, said side edge detection portion detecting a position of the side edge of the sheet to be abutted against said one of the aligning members; and a sheet moving unit provided upstream of said image forming portion, said sheet moving unit moving the sheet in the direction perpendicular to the sheet conveying direction, wherein on a basis of information from said side edge detection portion, said control portion controls said sheet moving unit to move the sheets at an image forming position determined from the one edges of the sheets at the side of the one of said aligning members chosen as the reference of the alignment.

11. An image forming apparatus according to claim 10, wherein said side edge detection portion has sensors configured to face each other upstream of said image forming portion to respectively detect positions of both side edges of the sheets in the direction perpendicular to the sheet conveying direction.

12. An image forming apparatus according to claim 10, wherein said stacking portion has a press member which presses the sheets against the one of said aligning members.

13. An image forming apparatus according to claim 10, wherein:

said binding part has a stapler, said stapler stapling the sheets stacked in said stacking portion, and said stapler staples the aligned sheet at the side of the one of said aligning members chosen as the reference of the alignment.

14. An image forming apparatus according to claim 10, wherein said side edge detection portion extends in the direction perpendicular to the sheet conveying direction on the upstream of said image forming portion by a length in which said side edge detection portion is capable of detecting positions of both side edges of the sheet in the direction perpendicular to the sheet conveying direction.

15. An image forming apparatus according to claim 14, wherein said side edge detection portion is a contact type line sensor.

* * * * *